US011344853B2

(12) United States Patent
Galaka et al.

(10) Patent No.: US 11,344,853 B2
(45) Date of Patent: May 31, 2022

(54) MULTIFUNCTIONAL HYDRODYNAMIC VORTEX REACTOR AND METHOD FOR INTENSIFYING CAVITATION

(71) Applicants: Oleksandr Galaka, Kyiv (UA); Oleksandr Kozlovskyi, Kyiv (UA); Yurii Matvienko, Kyiv (UA)

(72) Inventors: Oleksandr Galaka, Kyiv (UA); Oleksandr Kozlovskyi, Kyiv (UA); Yurii Matvienko, Kyiv (UA)

( * ) Notice: Subject to any disclaimer, the term of this patent is extended or adjusted under 35 U.S.C. 154(b) by 341 days.

(21) Appl. No.: 16/663,985

(22) Filed: Oct. 25, 2019

(65) Prior Publication Data

US 2020/0055009 A1 Feb. 20, 2020

Related U.S. Application Data

(63) Continuation-in-part of application No. 15/429,380, filed on Feb. 10, 2017, now Pat. No. 10,717,088.

(Continued)

(51) Int. Cl.
*B02C 19/06* (2006.01)
*B01F 25/10* (2022.01)

(Continued)

(52) U.S. Cl.
CPC ..... *B01F 25/10* (2022.01); *B01F 23/551* (2022.01); *B01F 31/87* (2022.01); *B01F 33/83* (2022.01); *B02C 19/061* (2013.01); *B02C 23/36* (2013.01)

(58) Field of Classification Search
CPC ..... B02C 19/06; B02C 19/061
See application file for complete search history.

(56) References Cited

U.S. PATENT DOCUMENTS 3,559,895 A * 2/1971 Fay ..... B02C 19/061 241/5
4,219,164 A * 8/1980 Taylor ..... B02C 19/061 241/5

(Continued)

OTHER PUBLICATIONS

A. Alhelfi, et al, "The cavitation phenomenon: a literature survey, Department of Energy Sciences", Lund University, Sweden. Advanced Computational Methods and Experiments in Heat Transfer XIII 351.

(Continued)

*Primary Examiner* — Faye Francis
(74) *Attorney, Agent, or Firm* — Aleksander Smushkevich

(57) ABSTRACT

The proposed multifunctional hydrodynamic vortex type reactor includes —a housing having curvilinear inner sidewalls, —a base attached to the housing, an inverse taper narrowing downward and attached to the top of housing, —a supporting tube passing at least through the housing and base, —a set of washers tapered downward and mounted on an outer surface of the supporting tube such that outer upper edges of the set of washers and the inner sidewalls form predetermined gaps therebetween, and —a number of inlets tangentially attached to the base for introducing, under external pressure, a solid substance and a liquid (or a suspension of their mixture) thereinto, forming a circulating flow therein. The flow forms a high speed bypassing cavitation zone and, changing its direction at the inverse taper, forms a vortex cavitation zone, providing for mixing and grinding the substance up to nanoscale sizes. Methods for intensifying cavitation are also provided.

6 Claims, 5 Drawing Sheets

Related U.S. Application Data

(60) Provisional application No. 62/298,101, filed on Feb. 22, 2016.

(51) Int. Cl.

| | |
|---|---|
| ***B02C 23/36*** | (2006.01) |
| ***B01F 23/50*** | (2022.01) |
| ***B01F 31/87*** | (2022.01) |
| ***B01F 33/83*** | (2022.01) |

(56) References Cited

U.S. PATENT DOCUMENTS 4,451,005 A * 5/1984 Urayama ..... B02C 19/061 241/152.1
4,538,764 A * 9/1985 Dunbar ..... B02C 19/065 241/39
4,579,288 A * 4/1986 McDermid ..... B02C 19/061 241/39
4,875,629 A * 10/1989 Brors ..... B02C 19/06 241/39
5,547,135 A * 8/1996 Moriya ..... B02C 19/061 241/40
9,067,212 B2 * 6/2015 Kato ..... B02C 13/288
9,669,412 B2 * 6/2017 Cattivelli ..... B02C 19/061
11,045,815 B2 * 6/2021 Tsuda ..... B02C 19/06
11,045,816 B2 * 6/2021 Albus ..... B02C 19/061
2013/0186990 A1 * 7/2013 Kato ..... B02C 13/288 241/39
2019/0291118 A1 * 9/2019 Iamartino ..... B02C 19/061

OTHER PUBLICATIONS

Anisimov V.V. et al. "Classification of Methods for Creation of Cavitation", Scientific Works, Edition 41, vol. 1, p. 30-32, 2012, Odessa National Academy of food technologies, Odessa, Ukraine ISSN-print: 2073-8730.

* cited by examiner

MULTIFUNCTIONAL HYDRODYNAMIC VORTEX REACTOR AND METHOD FOR INTENSIFYING CAVITATION

CROSS-REFERENCES TO RELATED APPLICATIONS

This U.S. patent application is a continuation-in-part application of a U.S. patent non-provisional application Ser. No. 15/429,380, published as US-2017-0239629-A1 (herein also referred to as "parent application"), filed on Feb. 10, 2017, entitled "Multifunctional hydrodynamic vortex reactor" (now U.S. patent Ser. No. 10/717,088), claiming the benefit of a U.S. patent provisional application Ser. No. 62/298,101 filed on Feb. 22, 2016, wherein the disclosure of the foregoing non-provisional application and provisional application is incorporated herein in its entirety by reference.

FIELD OF THE INVENTION

The present invention relates to the field of machine building technology and methods therefor, while the machines and methods can in turn be used for various industrial processes, such as:

- producing of fine suspensions in liquid-solid systems at production of fertilizers, biological additives, dyes, mortars, etc.;
- producing of fine emulsions and solutions in liquid-liquid systems for preparation of fuel mixtures, lubricant and cooling liquids, cosmetic and drug preparations, and food products;
- intensification of chemical and physical processes in liquids;
- water purification by mechanical destruction of bacteriological microflora;
- pasteurizing of food liquids mechanically at low temperatures;
- water ionization with a simultaneous introduction of required metal ions thereinto; and
- heating of fluids due to hydrodynamic effects.

BACKGROUND OF THE INVENTION

Nowadays, about 20% of electrical energy produced in the world is consumed during the process of grinding of different substances. Development of nanotechnologies stimulates growth of such tendency and, at the same time, requires more energy-saving solutions. As a rule, the grinding process to a size of less than 2 micrometers is quite energy intensive and expensive. Grinding substances to nanoscale mechanically is practically impossible. Therefore, the widespread use of such technologies in industry is limited. Use of the proposed invention allows for receiving nano-sized particles from different types of solid materials by means of a simple method of grinding in a liquid medium with substantial energy saving (from 7 to 60%) per one produced unit.

There are known a wide variety of hydrodynamic and aerodynamic machines used for different purposes. For example, there is known "a vortex mixer comprising a mixing chamber having an axial outlet and at least one inlet which is at least substantially tangential. The mixer further comprises a residence chamber extending axially on the side of the mixing chamber opposite from the axial outlet . . . ", described in US 2009/0201760 (Vorage et al.).

Vorage further teaches in paragraph [13]: "The invention also relates to a method of obtaining a supersaturated solution of a reaction product, wherein at least a first liquid stream containing a first reactant and a second liquid stream containing a second reactant are introduced into the above vortex mixer, generating an outer vortex in a direction away from the outlet of the mixer and an inner vortex in a direction towards the outlet, and wherein the reactants react to form the supersaturated solution."

As it follows from Vorage, its mixer is intended for mixing liquids and obtaining a supersaturated solution, but not for grinding of solid substances in liquids, especially to nano-size. Analyzing Vorage, it becomes apparent that its design does not allow obtaining high concentration of power, and therefore a high degree of mixture dispersion of particles (not to mention grinding to a nanoscale) of solid materials in liquid-solid systems, utilized for the aforementioned industrial processes.

There is also known an aerodynamic (not hydrodynamic) device described in US 2010/0065669 (Coles et al). It teaches: "[05] . . . a cyclone comprising: an upper cylindrical portion which opens into the wider end of a lower frustro-conical portion, with the longitudinal axes of said upper and lower portions aligned and substantially vertical; a primary air inlet into the cyclone arranged such that the inlet air is substantially tangential to the circumference of the cyclone; an exhaust outlet at or adjacent the top of the cylindrical portion; a control valve associated with said exhaust outlet and capable of partially or completely shutting off said exhaust outlet; a secondary air inlet associated with the narrow end of the frustro-conical portion and provided with an airflow stabilising device which is adapted to admit a stream of air substantially along or spirally around the longitudinal axis of the cyclone; means for removing processed product from the cyclone; means for moving said airflow stabilising device into and out of the narrow end of the frustro-conical portion during product processing and/or between product processing . . . [10] The present invention further provides a method of operating a cyclone as described above, wherein the airflow stabilising device is supplied with air from a blower or fan or, in the alternative, the airflow stabilising device is supplied with air simply by permitting air at ambient pressure to pass into said device . . . "

Coles further teaches a number of complicated discharge structural elements related to control of the cyclone (paragraphs [20], [21], [39]-[42]). According to Coles, its cyclone incorporates a significantly complicated "externally-mounted airflow stabilising device", whose purpose is "to admit a secondary stream of air into the lower end of the cyclone" in order to stabilize the cyclone (Coles—[40]). This is achieved by designing a bulky multi-component structure (Coles—[42]). Specifically, the admission of the "secondary stream of air into the lower end of the cyclone" is completed by using the tube 15*a* that creates a variable inner cavity in the frustro-conical portion 4 (Coles—FIG. 2).

Therefore, according to Coles, the mentioned variable inner cavity may function as an additional exhaust element that ultimately reduces the inner pressure in the device, which cannot provide (as it acts against) high concentration of power, and thus for a high degree of mixture dispersion of particles of solid materials in liquid-solid systems, utilized for the aforementioned industrial processes.

Also, there is known an aerodynamic (not hydrodynamic) device described in U.S. Pat. No. 3,768,172 (Klein et al). According to Klein (Col. 1, ln 3-1): "The invention relates to a tornado flow separator for processing fine-grain or granular particulate material by means of at least one gaseous medium, especially for the purpose of drying the particulate material. Such tornado flow separators are known per se and include a cylindrical reaction or vortex chamber with supply inlets for the gaseous media disposed in and extending tangentially to the wall or casing of the reaction chamber and at least one supply inlet for the particulate material disposed at an incline and tangentially to the chamber wall in the upper region of the chamber, and at least one outlet for the processed particulate material in the lower region of the reaction chamber, as well as axially disposed means for withdrawing the excess and/or spent gaseous media."

Further, according to Klein (Col. 4, ln. 56-63): "In FIG. 3, there is shown a helical flow dryer similar to that of FIG. 2, however, modified by annular diaphragms 18 and 19 which are additionally provided on the individual exhaust pipes 13 and 14 so that, according to the embodiment shown in FIG. 3, three reaction subchambers 20, 21, 22 are formed which are mutually partitioned from one another with respect to the air in the separator".

Typically, use of such diaphragms (partitions) cannot increase power of airflow (it does just the opposite, i.e. reduces power), not to mention increasing a power of liquid flow. Additionally, Klein's device is used as a separator, and cannot be used as a mixer-grinder. Its design therefore cannot provide for high concentration of power, and thus for a high degree of mixture dispersion of particles of solid materials in liquid-solid systems, utilized for the aforementioned industrial processes.

On the other hand, it is known that machines employed for the aforementioned industrial processes in some cases utilize cavitation processes. It is also known that cavitation processes create conditions for high power concentrated in a limited volume of liquid, while the extent of concentration depends on particular design of the machine employed for realization of cavitation.

In related art, there are known various machines employed for mixing of substances. For example, U.S. Pat. No. 3,614,069 teaches "Method and apparatus for obtaining a state of cavitation, emulsification and mixing wherein materials are subjected to a band of ultrasonic frequencies which are gradually shifted downwardly to cause bubbles in the material to grow and then applying a second set of ultrasonic frequencies but of a much lower frequency and of a higher intensity than the first ultrasonic frequencies for causing the bubbles to expand to a size such that catastrophic collapse takes place. The low-frequency ultrasound is also varied in frequency so as to cause the bubbles to collapse and implode. In this case, the lower frequency is caused to increase in frequency by periodically sweeping the lower frequency upward. The method and apparatus provide improved cavitation, emulsification and mixing of substances as, for example, water-in-oil."

The above mentioned method and apparatus employs a certain type of cavitation using ultrasonic frequencies. It does not however teach how to arrange its apparatus to achieve grinding/dispersion of solid materials within liquid-solid systems with this type of cavitation, especially grinding/dispersion to nano-size particles.

The parent application (US 20170239629-see above) filed by the instant inventors also utilizes the effect of cavitation. However, it has a distinct design that allows achieving high power concentration in a limited volume and a high degree of mixture dispersion (up to a nanoscale) of particles of solid materials, due to the use of certain physical processes.

The parent application discloses a multifunctional hydrodynamic vortex type reactor for grinding a solid substance, or mixing a solid substance with a liquid, comprising—a conical housing defining at least a top, a bottom, and inner sidewalls thereof; —a hollow base attached to the bottom of the housing; an inverse taper narrowing downward, the inverse taper is situated inside the housing, the inverse taper has an upper inner portion attached to the top of the housing; —a supporting tube passing through the base; the supporting tube includes an upper portion situated inside the housing, a lower portion situated below the base, and a discharge opening situated at a bottom of the lower portion of the supporting tube; —at least one washer mounted on an outer surface of the upper portion of said supporting tube such that outer edges of said at least one washer and the inner sidewalls of the housing form predetermined gaps therebetween; and—at least one inlet tangentially attached to the base for introducing at least the substance into the base providing for the grinding, or the mixing, or both.

Though the aforementioned multifunctional hydrodynamic vortex type reactor of the parent application does allow achieving high power concentration and a high degree of mixture dispersion (up to a nanoscale) of particles of different solid materials, it still can be improved. Due to extensive experimental work, the instant inventors discovered a way to further increase efficiency of the above-described invention. This new invention is disclosed herein below.

OBJECT AND BRIEF SUMMARY OF THE INVENTION

The object of the invention is to provide a multifunctional hydrodynamic vortex type reactor (herein also called a "MHVR") that allows achieving a high degree of mixture dispersion (up to the nanoscale) of particles of different solid materials, due to sequential or simultaneous use of certain physical processes disclosed herein below.

This object is achieved by implementation of the following physical processes taking place in the inventive MHVR: (i) simultaneous formation of turbulent, vortex and laminar fluid flows; (ii) creating conditions for cavitation with particles of different types and hardness, resulting in (iii) occurrence of cavitation cumulative jets, further followed by ultrasonic and shock waves, as well as ionization (i.e. secondary cavitation effects).

Thanks to the original design, the MHVR implements the sequential and controlled flow of two types of cavitation processes: (a) initial cavitation caused by a high speed liquid flow bypassing a solid body (such as shown in zone D on FIGS. 1, 4-5) and (b) vortex cavitation (such as shown in zone V on FIGS. 1, 4-5), conditioned by the initial high speed bypassing cavitation and configuration of certain elements of the MHVR described below.

The cavitation phenomenon is exemplary described in: A. ALHELFI & B. SUNDEN, Department of Energy Scienses, Lund University, Sweden. It explains certain effects produced by cavitation, such as occurrence of spherical shock and ultrasonic waves, emergence of high-speed microjets, occurrence of secondary ionization, etc., herein collectively called secondary cavitation effects, as mentioned above.

Another scientific publication by ANISIMOV V. V. at al. "Classification of Methods for Creation of Cavitation", Scientific Works, Edition 41, Volume 1, Odessa National Academy of food technologies, Odessa, Ukraine provides a detail classification of known methods for creation of cavitation. Specifically, a table presented on pages 31-32 shows two particular methods (second and third methods listed in the table): the second method of cavitation is called 'vortex', and the third method of cavitation is called 'high speed bypassing' of a solid body. These terms—'vortex cavitation' and 'high speed bypassing cavitation'—are used in this disclosure.

In the above mentioned publication, below the table (page 33), there is an explanation of the high speed bypassing cavitation, which is based on creation of a lower pressure zone arising behind a solid body being bypassed by the liquid due to a high speed movement of the liquid relatively to the solid body. According to the above publication (page 33), the method for creation of vortex cavitation is described as being based on rotation of the liquid flow, while a zone of lower pressure is created in the center of rotation causing cavitation that in turn causes impact on the liquid flow. These two types of cavitation are sequentially employed in the present invention for creating intense cavitation that is further used for grinding and fine dispersion of the solid body being processed in the MHVR.

As a result of the intense cavitation created in the MHVR, the following secondary local phenomena occur in the MHVR:—temperature increase to at least 500° C., pressure increase to 120 MPa at the point of collapse of cavitation bubbles.

The combination in the MHVR of the aforesaid two different types of cavitation (first—high speed bypassing cavitation and second—vortex cavitation) can significantly increase the aforementioned secondary cavitation effects, and therefore enhance energy concentration in a limited volume of the liquid (since it liberates internal energy of the liquid-solid system) and grinding impact on the solid substances placed therein. As shown above, the grinding process involves a two-stage cavitation sequence. It is also important to notice that these two stages must be followed in the sequential order described above (i.e. the high speed bypassing cavitation is always first, and the vortex cavitation is always second). The detail design of the MHVR and a method for intensification of cavitation are disclosed below.

In addition to the cavitation processes that occur, by organizing and optimizing the liquid flow inside the MHVR between the inverse cone 3 and the inlet of the supporting tube 4 (zone V in FIG. 4), an area of oppositely directed radial flows is created in which mutual shock collisions of particles of the solid substance in the liquid occur, which also leads to their mutual grinding.

Thus, the resulting cavitation energy, the energy of the secondary cavitation factors, and the impact energy of mutual collisions are concentrated at a certain time, in a limited space (FIGS. 4 & 5, zone V) inside the MHVR, which leads to alteration of physical and chemical properties of the processed mixture of solid substance and liquid. At the same time, the solid substances in the liquid are ground to the required size. The size of particles during the grinding of the solid substances, depending on their density, can reach nanoscale values, which is not achievable by any known grinding methods.

Therefore, according to one preferred embodiment of the invention, a multifunctional hydrodynamic vortex type reactor (MHVR) for mixing a solid substance with a liquid and grinding the solid substance therein comprises:—a hollow housing tapered downwards and defining at least a top, a bottom, and inner sidewalls thereof, wherein the inner sidewalls have a curvilinear shape, preferably a parabola shape; —a hollow base attached to the bottom of the housing; an inverse taper narrowing downward, situated inside the housing, and having an upper inner portion attached to the top of the housing; —a supporting tube passing through the base; the supporting tube includes an upper portion situated inside the housing, a lower portion situated below the base, and a discharge opening situated at a bottom of the lower portion of the supporting tube; —at least one washer (or a plurality of washers) mounted on an outer surface of the upper portion of the supporting tube such that outer edges of the at least one washer and the inner sidewalls of the housing form predetermined gaps therebetween; and—at least one inlet (or a number of inlets) tangentially attached to the base for introducing under external pressure at least the substance into the base providing for the mixing and grinding.

According to another preferred embodiment of the invention, a multifunctional hydrodynamic vortex type reactor (MHVR) for mixing a solid substance with a liquid and grinding the solid substance therein comprises:—a hollow housing tapered downward and defining at least a top, a bottom, and inner sidewalls thereof, wherein the inner sidewalls have a curvilinear shape, preferably a parabola shape; —a hollow base attached to the bottom of the housing; an inverse taper narrowing downward, situated inside the housing, and having an upper inner portion attached to the top of the housing; —a supporting tube passing through the base; the supporting tube includes an upper portion situated inside the housing, a lower portion situated below the base, a middle portion situated inside the base, and a discharge opening situated at a bottom of the lower portion of the supporting tube; —at least one washer (or a plurality of washers) mounted partially on an outer surface of the upper portion and partially on an outer surface of the middle portion of the supporting tube such that upper outer edges of the at least one washer and the inner sidewalls of the housing form predetermined gaps therebetween; and—at least one inlet (or a number of inlets) tangentially attached to the base for introducing under external pressure, at least the solid substance into the base providing for the mixing and the grinding.

Yet, according to another preferred embodiment, the invention proposes a method for intensification of cavitation in a liquid comprising the steps of:—providing a hollow cylindrical base; a hollow housing mounted above the base, including a top and internal sidewalls tapered upward and communicating with the base; a conical inverse taper narrowing downward attached to the top of the housing; a set of washers tapered downward, including an upper portion mounted within the housing below the conical inverse taper, wherein the upper portion defines outer edges of the set of washers, wherein the outer edges and the inner sidewalls form predetermined gaps therebetween, and wherein an internal volume is defined between the inverse taper and a top surface of the upper portion of the set of washers; —providing a liquid flow under external pressure circulating in the base; —passing the liquid flow through the predetermined gaps thereby initiating cavitation of a high-speed bypassing type, wherein the liquid bypasses the set of washers with a high speed in a first cavitation zone situated above and around the outer edges; —passing the liquid flow upward into the internal volume between the inverse taper and the top surface creating cavitation of a vortex type in a second cavitation zone situated in the internal volume, thereby providing for the intensification of cavitation in the liquid.

DRAWINGS OF THE INVENTION

The following drawings attached hereto illustrate the invention. In particular:

BRIEF DESCRIPTION OF PREFERRED EMBODIMENTS OF THE INVENTION

Figure 1:
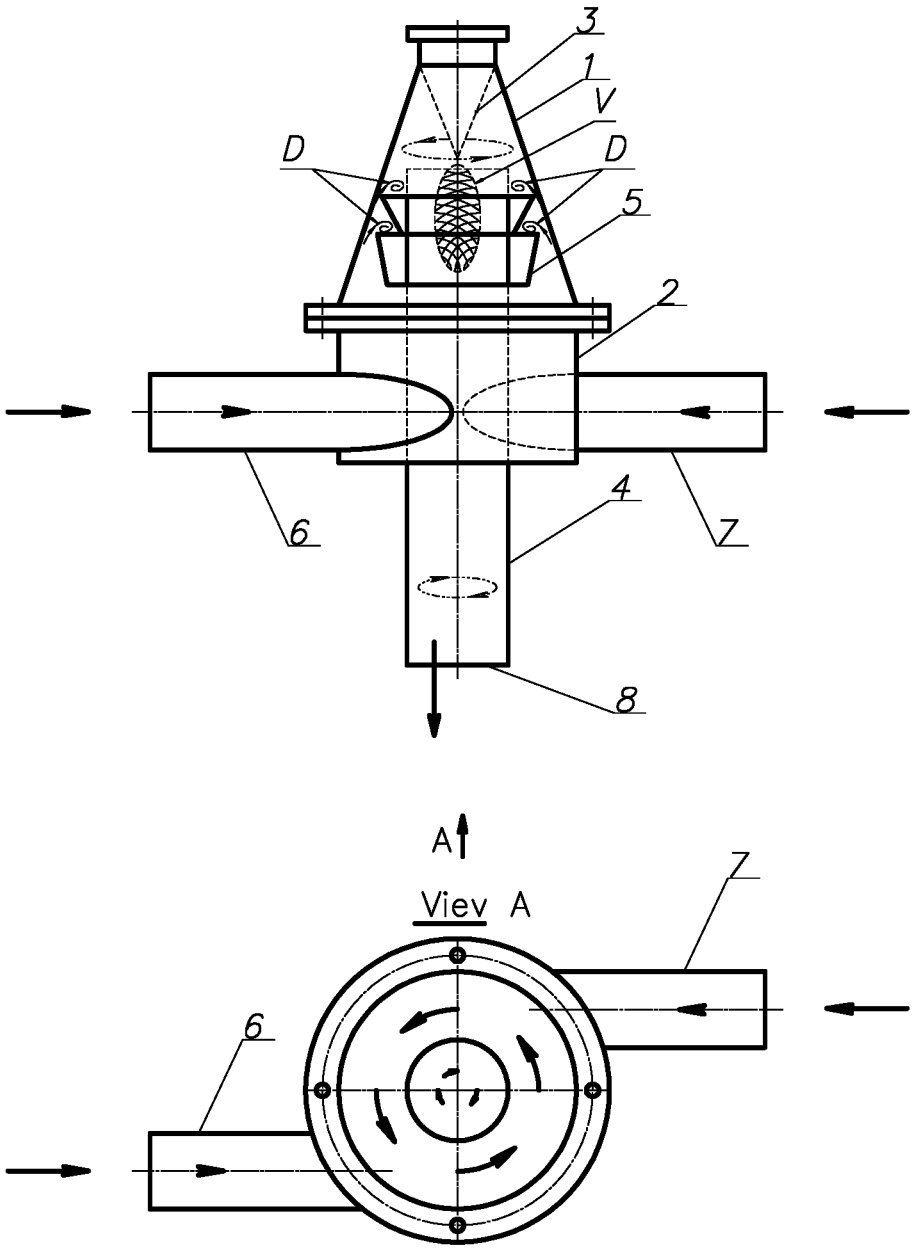
FIG. 1 illustrates a frontal projection and a plan projection of the multifunctional hydrodynamic vortex type reactor, according to the parent application.

While the invention may be susceptible to embodiment in different forms, there is shown in the drawing, and will be described in detail herein, a specific exemplary embodiment of the present invention, with the understanding that the present disclosure is to be considered an exemplification of the principles of the invention, and is not intended to limit the invention to that as illustrated and described herein.

Figure 4:
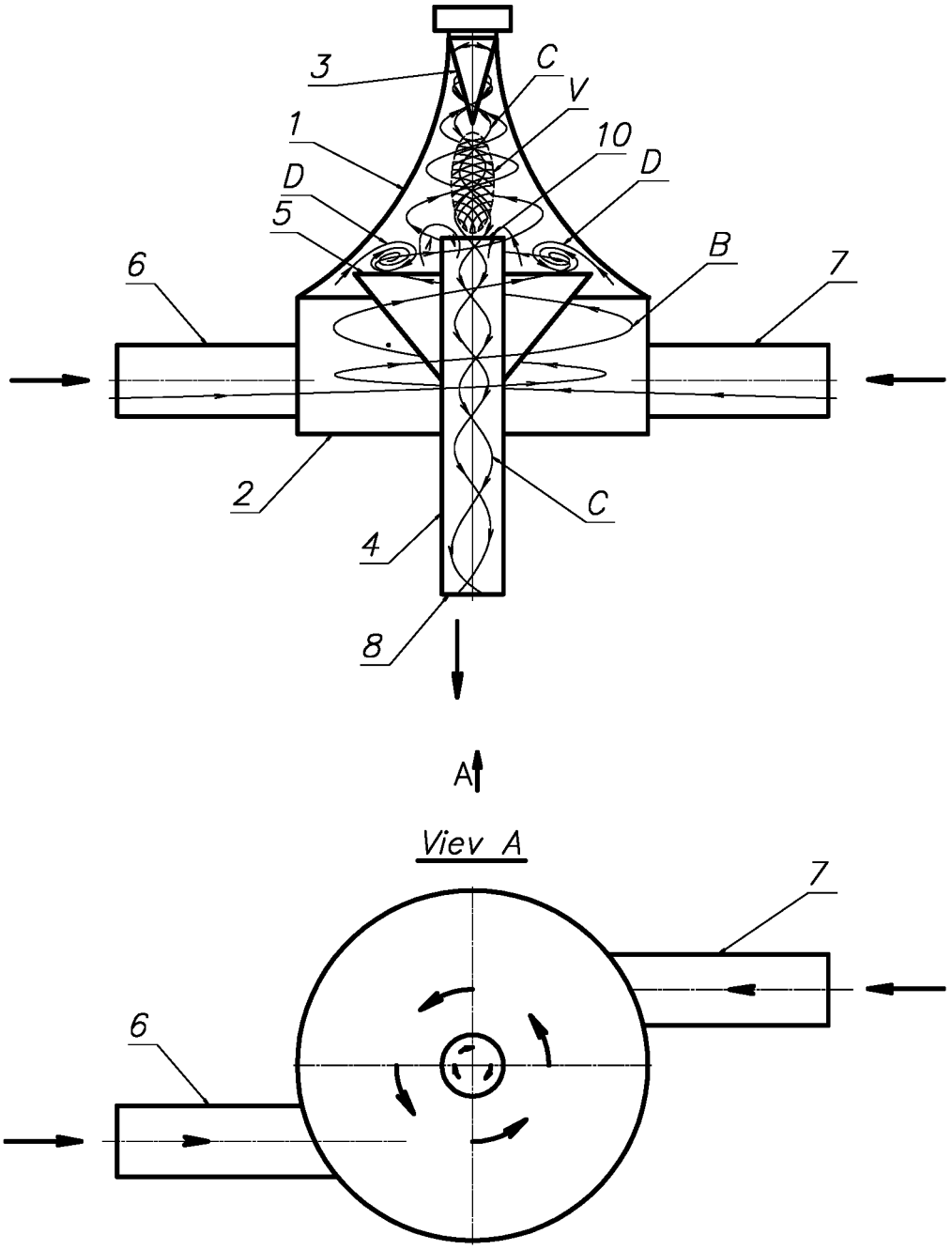
FIG. 4 illustrates a frontal projection and a plan projection of the MHVR, according to a preferred embodiment of the present invention.

According to one preferred embodiment (FIG. 4), the inventive MHVR comprises: a housing 1 tapered upward and having curvilinear internal walls (wherein the preferable shape of the internal walls is parabola); a hollow base 2 (preferably of a cylindrical shape) attached to the bottom of housing 1; an inverse taper 3 (preferably of a conical shape) narrowing downward with its upper inner portion attached to the top of housing 1 preferably by means of a threaded joint; a supporting pipe 4 having a top inlet 10 and a bottom discharge outlet 8, and passing through the base 2, while an upper portion of supporting tube 4 is situated inside the housing 1, a middle portion of supporting tube 4 is situated inside the base 2, and a lower portion of supporting tube 4 is situated outside the housing 1 below the base 2; and a set of washers 5 (one washer 5 is shown in FIG. 4), tapered downward, while the set of washers 5 is situated partially inside the housing 1 and partially inside the base 2, and wherein the set of washers 5 is mounted partially on the outer surface of the upper portion of supporting tube 4 and partially on the outer surface of the middle portion of supporting tube 4, such that the upper outer edges of washers 5 and the inner sidewalls of housing 1 form predetermined gaps.

According to another preferred embodiment (FIG. 5), the inventive MHVR comprises: a housing 1 tapered upwards and having curvilinear internal walls (wherein the preferable shape of the internal walls is parabola); a hollow base 2 (preferably of a cylindrical shape) attached to the bottom of housing 1; an inverse taper 3 (preferably of a conical shape) narrowing downwards with its upper inner portion attached to the top of housing 1 preferably by means of a threaded joint; a supporting pipe 4 having a top inlet 10 and a bottom discharge outlet 8, and passing through the base 2, while an upper portion of supporting tube 4 is situated inside the housing 1 and a lower portion of supporting tube 4 is situated outside the housing 1; and a set of washers 5, tapered downward, and mounted on the outer surface of the upper portion of supporting tube 4 such that the upper outer edges of washers 5 and the inner sidewalls of housing 1 form predetermined gaps.

Figure 3:
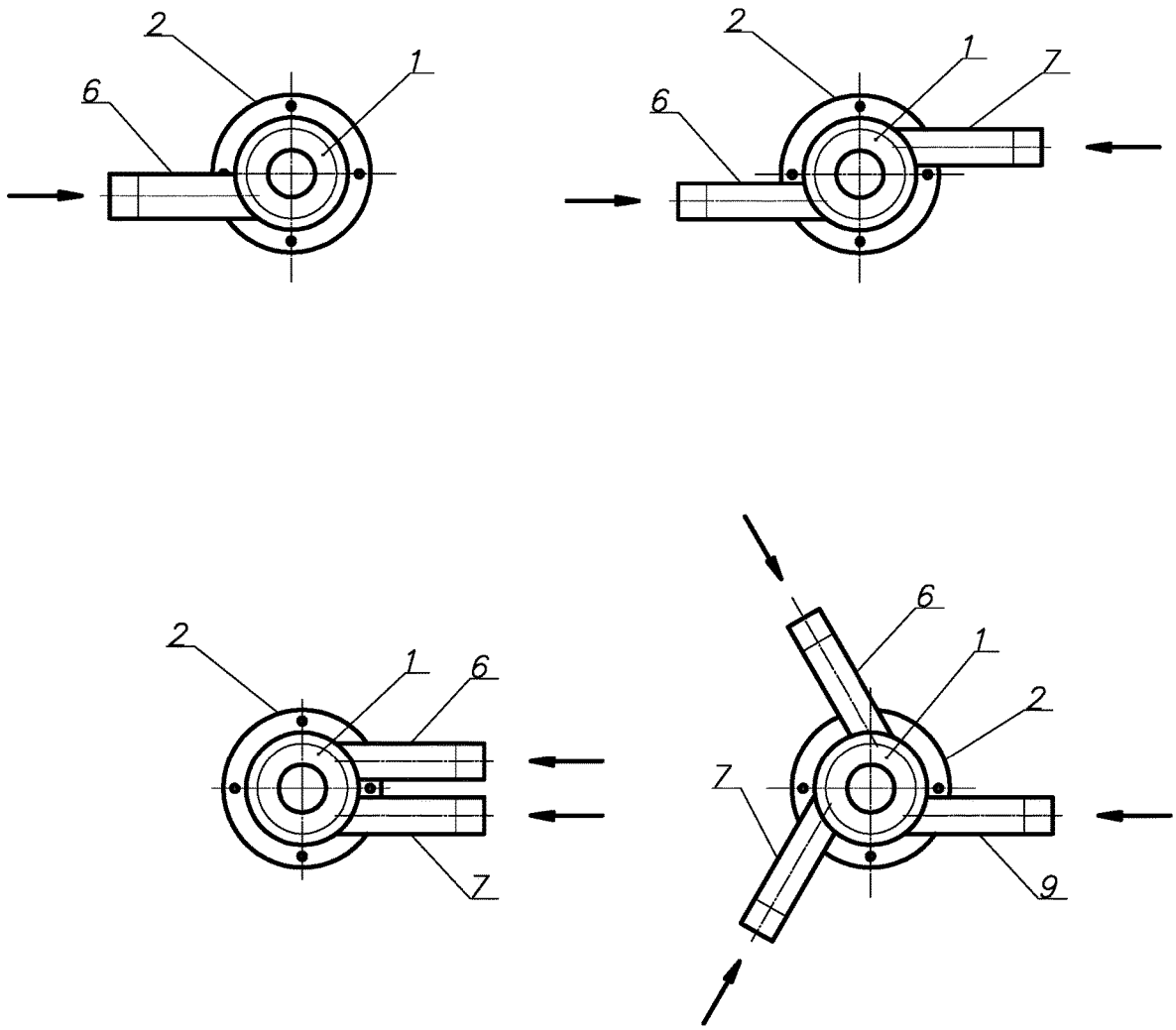
FIG. 3 illustrates frontal projections of four optional configurations of a base of the MHVR, according to preferred embodiments of the present invention.

The base 2 of the MHVR, depending on particular purposes of mixing and grinding, can have a single inlet 6, or multiple tangential inlets 6, 7 and 9, which may be aligned in the same direction or in different directions (including the opposite direction) as shown in FIG. 3. The inlet(s) provide input of working liquid and/or a preliminary prepared suspension of solid substances to be mixed and ground, as well as serve the purpose of initially creating a peripheral flow B of the liquid circulating inside the base 2, as shown in FIG. 4. The working liquid or the preliminary prepared suspension is introduced into the base 2 under external pressure.

Figure 2:
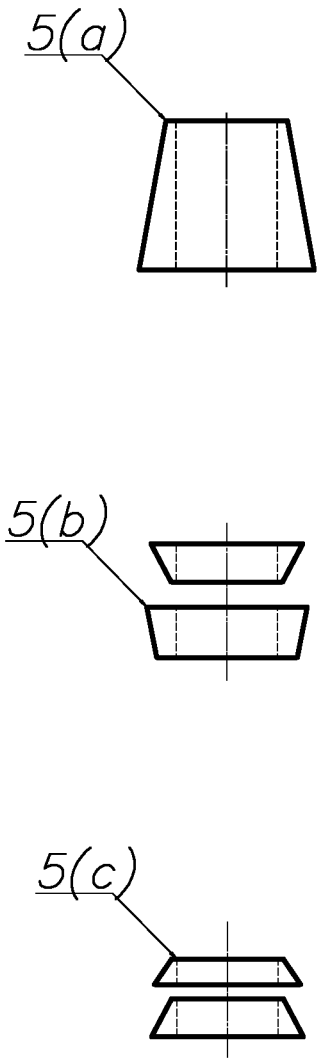
FIG. 2 illustrates frontal projections of three optional configurations of washers of the MHVR, according to preferred embodiments of the present invention.

The supporting tube 4 in conjunction with the inverse taper 3 and the set of washers 5 (FIG. 1 exemplarily depicts two washers 5, whereas FIG. 4 depicts one washer 5 to facilitate showing liquid flows). The set of washers 5 is provided for structuring the process of liquid flow and creating conditions for primary (initial) cavitation surrounding a solid body (i.e. the washer(s) 5 being the solid body in this case) placed within the MHVR. The washers 5, depending on the nature of solid substance ground/mixed in the MHVR, may have various configurations, for example, as shown in FIG. 2: 5(*a*), 5(*b*) and 5(*c*). Discharge of the liquid flow from the MHVR is provided through the bottom discharge outlet 8 (see above).

The peripheral flow B (shown in FIG. 4) rises to upper outer edges of the washer 5, wherein it bypasses the outer edges and initiates primary cavitation (zone D in FIGS. 1 & 4) around there. Due to the primary cavitation, the liquid turns into a vapor-gas mixture and continues to move towards the top of the housing 1. This preliminary transformation of the liquid flow creates conditions for the secondary (vortex) cavitation (zone V in FIGS. 1 & 4), which significantly increases intensity of the cavitation process in whole within MHVR.

The movement of liquid along the inner walls of the housing 1 has a vortex character and, due to the shape of the inner walls (made curvilinear, preferably parabolic, and tapered upward), is accelerated by radial velocity. Reaching the inverse taper 3, the liquid movement turns in the opposite direction, causing formation of an internal/axial vortex liquid flow C (FIG. 4).

Figure 5:
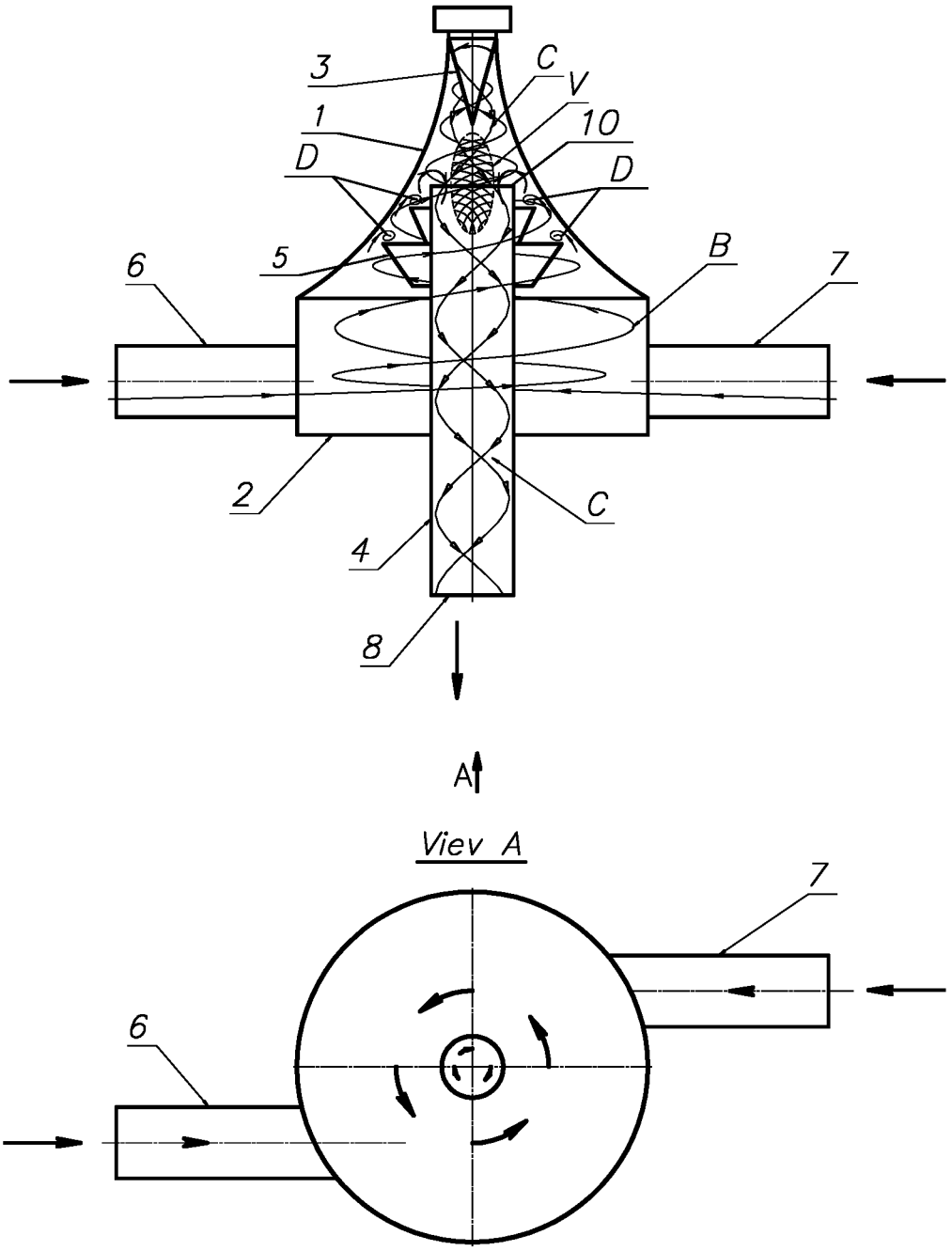
FIG. 5 illustrates a frontal projection and a plan projection of the MHVR, according to another preferred embodiment of the present invention.

Due to the shape of the inverse taper 3, the axial vortex flow C continues moving at high radial speed in the opposite direction. The interaction of the peripheral flow B and the counter-axial vortex flow C in the space between the inverse taper 3 and the top inlet 10 of the supporting tube 4 forms a limited zone V of intensive vortex cavitation (FIGS. 1, 4, 5). In the zone V, a mutual collision of particles of the solid substance in the liquid occurs.

Thus, in the limited zone V, a simultaneous multifactorial energy effect on the liquid and solid substance arises as a result of physical phenomena artificially created in the MHVR. By varying the size and shape of the inverse taper 3, as well as the size and shape of the internal curvilinear (preferably parabolic) walls of the housing 1, it is possible to change the size and configuration of zone V; this, in turn, allows changing processing modes of the mixture of liquid and solid substances contained therein.

Practical experiments conducted by the instant inventors, as well as computer simulations, showed that the velocity of the liquid in some parts of the MHVR, compared with the input velocity of the peripheral flow B, increases tens of times.

Based on the formula for determining energy of a moving body: $E=m*V^2$, it can be demonstrated that the energy of the body (i.e. the flow of mixture of the liquid and solid particles) moving in the MHVR can increase by several orders of magnitude (e.g. up to 100 times).

The diameter and height of the housing 1, the diameter of the base 2, and the diameter of the supporting tube 4 are calculation values and can be predetermined for a particular embodiment of the invention, which depends on characteristics of the solid substance to be ground and mixed within the MHVR, the required size of ground particles, and the particular shape of the MHVR.

The present invention also proposes a method for intensification of cavitation of a liquid, preferably using the MHVR. In preferred embodiment, the method comprises the steps of:—providing a hollow cylindrical base 2; a hollow housing 1 mounted above the base, including a top and internal sidewalls tapered upward and communicating with the base 2; a conical inverse taper 3 narrowing downward having an upper part attached to the top of the housing 1; a set of washers 5 tapered downward, including an upper portion having a top surface and at least partially mounted within the housing 1 below the inverse taper 3, wherein the upper portion defines outer upper edges of the set of washers, wherein the outer upper edges and the inner sidewalls form predetermined gaps therebetween, and wherein an internal volume is defined between the inverse taper 3 and the top surface of the upper portion of the set of washers 5; —providing a liquid flow circulating in the base 2 under external pressure; —passing the liquid flow through the predetermined gaps thereby initiating cavitation of a high-speed bypassing type (see above), wherein the liquid bypasses a solid body (in this case, the set of washers 5) with a high speed in a first cavitation zone (zone D) situated above and around the outer upper edges; —passing the liquid flow upward into the internal volume between the inverse taper and the top surface creating cavitation of a vortex type in a second cavitation zone situated (zone V) in the internal volume, thereby providing for the intensification of cavitation of the liquid.

Herein the high speed of the liquid flow bypassing the solid body can be experimentally predetermined by varying the speed by means of adjusting shapes, relative positions, and sizes of the housing 1 and the set of washers 5.

BEST DESIGN MODE FOR CARRYING OUT THE INVENTION

As a result of numerous practical experiments conducted by the instant inventors, a certain dependence of energy characteristics of the MHVR upon geometric shape of the housing 1 was established. The most effective design for the housing 1 was discovered having curvilinear (especially parabolic) shape of the internal walls, shown in FIGS. 4 and 5.

Comparative characteristics of the MHVR with the housing having internal walls with a conical shape (disclosed in the parent application, annotated "MHVR—conical") and the MHVR with the housing having internal walls with a tapered upward parabolic shape (annotated "MHVR—parabolic") are represented in the table below.

| | Pressure at the entrance [bar] | Maximum pressure [bar] | Input speed of liquid flow [m/s] | Maximum speed of liquid flow [m/s] | Steam concentration [%] | Turbulence energy [J/kg] |
|---|---|---|---|---|---|---|
| MHVR - conical | 5 | 12.5 | 4 | 40.1 | 74 | 34.1 |

-continued

| | Pressure at the entrance [bar] | Maximum pressure [bar] | Input speed of liquid flow [m/s] | Maximum speed of liquid flow [m/s] | Steam concentration [%] | Turbulence energy [J/kg] |
|---|---|---|---|---|---|---|
| MHVR - parabolic | 5 | 46.4 | 4 | 80 | 95 | 114 |

Thus, it is noticeable that, under equal initial conditions, due to optimization of the geometric shape of the inner walls of the housing, the energy characteristics of the MHVR with parabolic inner walls have critically increased comparatively with the MHVR with conical inner walls (disclosed in the parent application), specifically from about 1.5 to more than 3 times. This means that the above-described grinding process can be conducted with a significantly higher efficiency and lower input energy.

The size of washers 5 providing for the cavitation process depends on the size (linear and angular dimensions) and configuration of the housing 1, the configuration of washers 5, and their design is determined depending on cavitation modes required.

The design of MHVR includes no moving parts, which significantly simplifies its production, increases its reliability, and extends its operational lifespan.

The liquid is introduced into the base 2 at a certain pressure, for example, through the tangential inlet 6 (FIGS. 1 & 4). A solution containing the solid substance to be ground and/or mixed in the MHVR is introduced through the inlet 7. Depending on the physical characteristics of the solid substance, the substance can be fed into the MHVR, for example, in a dry form through the inlet 7 using an appropriate known ejector, or in the form of preliminary prepared solution containing the solid substance.

The liquid flow, under external pressure and due to the design of the base 2, takes a vortex, laminar or turbulent form. Then the mixed flow (i.e. a mixture of the solid substance and liquid introduced via the inlets 6 and 7), rising along the inner sidewalls of the housing 1, enters into the gaps between the inner sidewalls of housing 1 and the outer edges of washers 5 thus forming a cavitation zone.

Cavitation modes, depending on the characteristics of the substance to be ground/mixed, are determined by a selection of configurations of the washers 5. Having passed the cavitation zone, the flow rises to the inverse taper 3, and then changes its direction of circulation to the opposite one (this effect is also known as a gyratory motion along inner sidewalls of a chamber; it was observed by the instant inventors), while maintaining the character of vortex motion. Upon the reversal of the flow circulation, the most intensive grinding/mixing of the substance occurs due to a mutual collision of particles in the fluid flows moving in the opposite directions.

The so treated liquid flow is discharged through the supporting pipe 4. To obtain a required result of grinding/mixing, the treatment process in the MHVR is cycled during a predetermined time. Thus, the treatment of the flow passing through the MHVR results in dispersion of the suspension containing the solid substance and liquid, providing a reduction of the size of the substance's particles to nanometers. It may also activate physical and chemical processes occurring in the liquid.

OPERATION OF THE INVENTION

The MHVR operates as follows. Before launching, the suspension of liquids and solid substance to be ground are prepared in a separate container, while the suspension has a concentration required by technology of the process. The working liquid is fed into the inlet 6 under pressure, and the suspension, prepared in the container, is fed into the inlet 7 at the same time (shown in FIGS. 1 & 4).

At the base 2, these two flows are mixed and a resultant flow takes a vortex turbulent form (the direction of liquid flow in the lower and middle parts of housing 1 is shown in FIG. 1 by ordinary arrows) due to the design of MHVR. Further, under the influence of centrifugal force, the flow rises along the inner sidewall of the housing 1, while generating the above described two-stage cavitation process in the region of the washers 5 and inverse taper 3, achieving intensive grinding/mixing of the solid substance.

Upon rising to the upper part of the housing, the liquid flow turns back in the opposite direction (the direction of liquid flow in the upper part of housing 1 is shown in FIG. 1 by double arrows) forming a counter-flow, while maintaining the character of the vortex motion. After turning back at 180.degree. of the rotating liquid flow, an intensive grinding of the substance particles occurs due to their mutual collision produced by moving of the flow and the counter flow. The intensity of interaction of the two flows in the aforesaid MHVR zone depends on the configuration of the inverse taper 3.

Upon passing through the MHVR, the so treated flow is discharged through the discharge opening 8. The treatment time of particular substance depends on its physical characteristics and requirements for its grinding/mixing, as well as on the pressure of the fluid flow at the inlet.

We claim:

1. A multifunctional hydrodynamic vortex reactor for mixing a solid substance with a liquid and grinding the solid substance therein, said multifunctional hydrodynamic vortex reactor comprising: a hollow housing (1) defining at least a top, a bottom, inner sidewalls, and a central vertical longitudinal axis thereof, wherein the inner sidewalls are tapered upward forming, in a cross-sectional plane extended through the central vertical longitudinal axis, a parabola; a hollow base (2) attached to the bottom of said housing (1); an inverse taper (3) narrowing downward, the inverse taper (3) is situated inside the housing (1), the inverse taper (3) has an upper portion attached to the top of said housing (1); a supporting tube (4) passing through the base (2); said supporting tube (4) includes an upper portion situated inside the housing (1), said upper portion having a tube inlet (10) on a top thereof, a middle portion situated inside the base (2), and a low portion situated below the base (2) having a discharge outlet (8) situated at a bottom of the lower portion of said supporting tube (4); at least one washer (5) mounted partially on an outer surface of the upper portion and partially on an outer surface of the middle portion of said supporting tube (4), such that outer upper edges of said at least one washer (5) and the inner sidewalls of said housing (1) form predetermined gaps therebetween; and at least one inlet tangentially attached to the base (2) for introducing under external pressure at least said solid substance with said liquid into the base (2), thereby providing for said mixing and grinding.

2. The multifunctional hydrodynamic vortex reactor according to claim 1, wherein said at least one inlet further includes a first inlet (6) for introducing said solid substance into the base (2) and a second inlet (7) for introducing said liquid into the base (2), such that the solid substance and the liquid form a suspension circulating inside the base (2) in a predetermined direction.

3. The multifunctional hydrodynamic vortex reactor according to claim 1, wherein said at least one washer (5) further includes a plurality of washers of predetermined shapes.

4. A multifunctional hydrodynamic vortex reactor for mixing a solid substance with a liquid and grinding the solid substance therein, said multifunctional hydrodynamic vortex reactor comprising: a hollow housing (1) defining at least a top, a bottom, inner sidewalls, and a central vertical longitudinal axis thereof, wherein the inner sidewalls are tapered upward forming, in a cross-sectional plane extended through the central vertical longitudinal axis, a parabola; a hollow base (2) attached to the bottom of said housing (1); an inverse taper (3) narrowing downward, the inverse taper (3) is situated inside the housing (1), the inverse taper (3) has an upper portion attached to the top of said housing (1); a supporting tube (4) passing through the base (2); said supporting tube (4) includes an upper portion situated inside the housing (1), said upper portion having a tube inlet (10) on a top of said upper portion; and said supporting tube (4) includes a low portion situated in and below the base (2), having a discharge outlet (8) situated at a bottom of the lower portion of said supporting tube (4); at least one washer (5) mounted on an outer surface of the upper portion of said supporting tube (4), such that outer upper edges of said at least one washer (5) and the inner sidewalls of said housing (1) form predetermined gaps therebetween; and at least one inlet tangentially attached to the base (2) for introducing under external pressure at least said solid substance with said liquid into the base (2), thereby providing for said mixing and grinding.

5. The multifunctional hydrodynamic vortex reactor according to claim 4, wherein said at least one inlet further includes a first inlet (6) for introducing said solid substance into the base (2) and a second inlet (7) for introducing said liquid into the base (2), such that the solid substance and the liquid form a suspension circulating inside the base (2) in a predetermined direction.

6. The multifunctional hydrodynamic vortex reactor according to claim 4, wherein said at least one washer (5) further includes a plurality of washers of predetermined shapes.

* * * * *